US008328620B2

(12) United States Patent
Boesen

(10) Patent No.: US 8,328,620 B2
(45) Date of Patent: Dec. 11, 2012

(54) HYBRID GAMING SYSTEM

(75) Inventor: John Leslie Boesen, Menai (AU)

(73) Assignee: Aristocrat Technologies Australia Pty Limited (AU)

( * ) Notice: Subject to any disclaimer, the term of this patent is extended or adjusted under 35 U.S.C. 154(b) by 1020 days.

(21) Appl. No.: 12/239,220

(22) Filed: Sep. 26, 2008

(65) Prior Publication Data

US 2009/0191963 A1 Jul. 30, 2009

(30) Foreign Application Priority Data

Sep. 27, 2007 (AU) ..... 2007905315

(51) Int. Cl.
*A63F 9/24* (2006.01)

(52) U.S. Cl. ..... 463/20; 463/16; 463/25

(58) Field of Classification Search ..... 463/16–20, 463/25–29

See application file for complete search history.

(56) References Cited

U.S. PATENT DOCUMENTS

| | | | | |
|---|---|---|---|---|
| 5,772,509 | A | 6/1998 | Weiss | |
| 7,128,645 | B1 | 10/2006 | White et al. | |
| 7,419,425 | B1 * | 9/2008 | Crowder et al. | 463/16 |
| 2003/0036429 | A1 | 2/2003 | Witty et al. | |
| 2003/0109307 | A1 | 6/2003 | Boyd | |
| 2004/0048667 | A1 | 3/2004 | Rowe | |
| 2005/0096114 | A1 | 5/2005 | Cannon et al. | |
| 2006/0160620 | A1 | 7/2006 | Matthews et al. | |
| 2006/0287106 | A1 | 12/2006 | Jensen | |
| 2007/0060262 | A1 | 3/2007 | Kosaka et al. | |
| 2007/0060329 | A1 | 3/2007 | Martin | |
| 2007/0066378 | A1 | 3/2007 | White et al. | |
| 2007/0093297 | A1 | 4/2007 | Moshal | |
| 2007/0117608 | A1 | 5/2007 | Roper et al. | |
| 2007/0155477 | A1 | 7/2007 | Gevisser | |
| 2007/0197294 | A1 | 8/2007 | Gong | |

FOREIGN PATENT DOCUMENTS

| | | |
|---|---|---|
| CA | 2559412 | 3/2007 |
| CA | 2527367 | 5/2007 |
| CA | 2527416 | 5/2007 |
| GB | 2433625 | 6/2007 |
| JP | 2006236071 | 9/2006 |
| JP | 2007014798 | 1/2007 |
| JP | 2007014808 | 1/2007 |
| JP | 2007050128 | 3/2007 |
| KR | 20020062595 | 7/2002 |
| KR | 20040037650 | 5/2004 |

(Continued)

*Primary Examiner* — Omkar Deodhar

(74) *Attorney, Agent, or Firm* — McAndrews, Held & Malloy, Ltd.

(57) ABSTRACT

A hybrid gaming system comprising: an electronic gaming machine (EGM) comprising: a cabinet; a base game interface disposed within the cabinet and comprising a display and a base game player instruction input mechanism, a processor disposed within the cabinet and arranged to conduct a base game based on at least one player instruction received from the base game player instruction input mechanism; a feature game device mounted to the cabinet and comprising a feature game display mounted to the cabinet and a feature game instruction mechanism operable by the player to input at least one instruction; a trigger monitor arranged to determine that a trigger event has occurred such that a feature game is to be conducted; and a feature game controller located remotely from the EGM and responsive to the trigger monitor to generate feature data for at least one feature game to be displayed on the feature game display and to process the at least one instruction.

26 Claims, 6 Drawing Sheets

FOREIGN PATENT DOCUMENTS

| | | | |
|---|---|---|---|
| KR | 100463145 | B | 12/2004 |
| KR | 20050021624 | | 3/2005 |
| WO | 2004090823 | | 10/2004 |
| WO | 2005107899 | A1 | 11/2005 |
| WO | 2006124922 | | 11/2006 |

* cited by examiner

HYBRID GAMING SYSTEM

RELATED APPLICATIONS

This application claims priority to Australian Provisional Patent Application No. 2007905315, having a filing date of Sep. 27, 2007, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to a hybrid gaming system, a method of gaming and a gaming apparatus.

Typical gaming machines deployed to the floor of gaming venues are stand alone gaming machines where the base game and any associated feature game triggered from the base game are both implemented by a processor mounted on a main board within the gaming machine.

The present invention relates to an alternative technique for carrying out a feature game.

BRIEF SUMMARY OF THE INVENTION

In a first aspect the invention provides a hybrid gaming system comprising:

- an electronic gaming machine (EGM) comprising:
  - a cabinet;
  - a base game interface disposed within the cabinet and comprising a display and a base game player instruction input mechanism,
  - a processor disposed within the cabinet and arranged to conduct a base game based on at least one player instruction received from the base game player instruction input mechanism;
  - a feature game device mounted to the cabinet and comprising a feature game display mounted to the cabinet and a feature game instruction mechanism operable by the player to input at least one instruction;
  - a trigger monitor arranged to determine that a trigger event has occurred such that a feature game is to be conducted; and
- a feature game controller located remotely from the EGM and responsive to the trigger monitor to generate feature data for at least one feature game to be displayed on the feature game display and to process the at least one instruction.

In an embodiment, the feature game device comprises a feature game processor arranged to process feature data received from the feature game controller and to cause the feature game display to display the game.

In an embodiment, the feature game device comprises a memory storing local data and the feature game processor processes the local data in conjunction with the feature data to cause the display to display the feature game.

In an embodiment, the local data comprises at least graphics data.

In an embodiment, the feature game device is in data communication with the processor of the EGM.

In an embodiment, the feature game device is arranged to prevent the processor of the EGM from conducting the base game during the feature game.

In an embodiment, the feature game device is in data communication with the processor of the EGM via a serial port of the EGM.

In an embodiment, the feature game device provides at least one additional function independent of the feature game.

In an embodiment, the feature game device is a player marketing module in data communication with a player tracking system.

In an embodiment, the feature game device implements the trigger monitor.

In an embodiment, the processor of the EGM implements the trigger monitor.

In an embodiment, the hybrid gaming system comprises a plurality of EGMs in data communication with the feature game controller, the feature game controller arranged to generate feature data for a feature device of each EGM on demand.

In a second aspect the invention provides a hybrid gaming method comprising:

- conducting a base game on an electronic gaming machine (EGM) having a cabinet;
- monitoring for a trigger event to occur in the base game such that a feature game is to be conducted;
- receiving at least one instruction from a feature game instruction mechanism of a feature game device mounted to the cabinet;
- generating feature data specifying at least one feature game at a feature game controller located remotely from the EGM when it is monitored that a feature game is to be conducted based partly on the feature game instruction; and
- displaying a feature game specified by the feature data on a feature game display of the feature game device.

In an embodiment, the method further comprises storing local data at the EGM and processing the local data in conjunction with the feature data to cause the display to display the feature game.

In an embodiment, the method further comprises preventing the EGM from conducting the base game during the feature game.

In a third aspect the invention provides a hybrid gaming apparatus comprising:

- an electronic gaming machine (EGM) comprising:
  - a cabinet;
  - a base game interface disposed within the cabinet and comprising a display and a base game player instruction input mechanism,
  - a processor disposed within the cabinet and arranged to conduct a base game based on at least one player instruction received from the base game player instruction input mechanism;
  - a feature game device mounted to the cabinet and comprising a feature game display mounted to the cabinet and a feature game instruction mechanism operable by the player to input at least one instruction,
- the feature game display operable to display at least one feature game based on feature game data received from a feature game controller located remotely from the EGM.

In an embodiment, the feature game device comprises a feature game processor arranged to process feature data received from the feature game controller and to cause the feature game display to display the game.

In an embodiment, the feature game device comprises a memory storing local data and the feature game processor processes the local data in conjunction with the feature data to cause the display to display the feature game.

In an embodiment, the local data comprises at least graphics data.

In an embodiment, the feature game device is in data communication with the processor of the EGM.

In an embodiment, the feature game device is arranged to prevent the processor of the EGM from conducting the base game during the feature game.

In an embodiment, the feature game device is in data communication with the processor of the EGM via a serial port of the EGM.

In an embodiment, the feature game device provides at least one additional function independent of the feature game.

In an embodiment, the feature game device is a player marketing module in data communication with a player tracking system.

In an embodiment, the feature game device implements the trigger monitor.

In an embodiment, the processor of the EGM implements the trigger monitor.

DETAILED DESCRIPTION OF THE INVENTION

The embodiment, provides a hybrid gaming system where a base game is carried out on an electronic gaming machine (EGM) and a feature game controller remote from the EGM generates data for a feature game so that the feature game can be displayed on a feature game display mounted to the EGM. In the embodiment, the feature game display is provided by the display of a player marketing module (PMM) mounted within the cabinet of the EGM.

Figure 1:
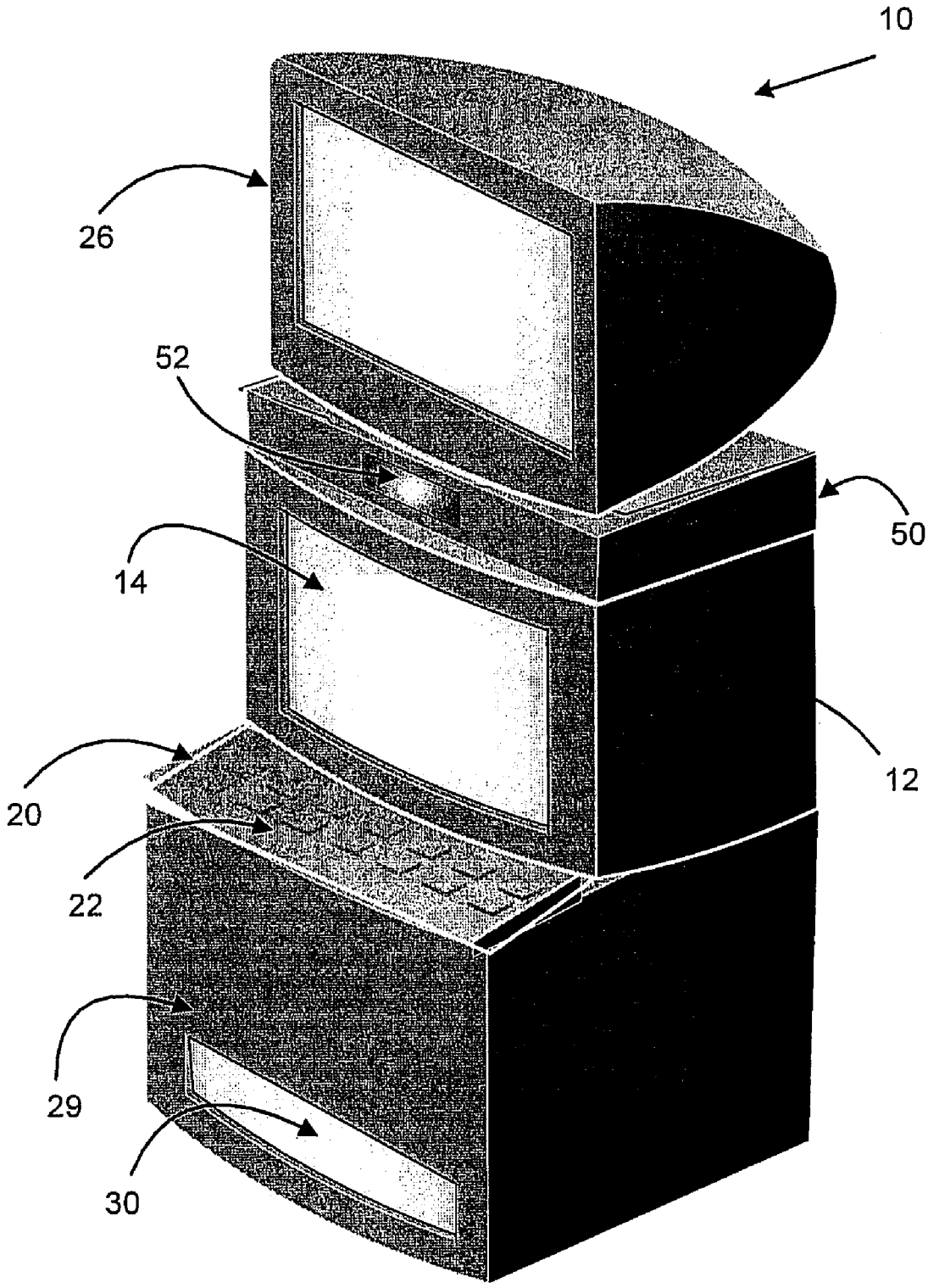
FIG. 1 is a perspective view of a gaming machine.

A stand alone gaming machine 10 is illustrated in FIG. 1. The gaming machine 10 includes a cabinet 12 having a display 14 on which is displayed representations of a game that can be played by a player. A mid-trim 20 of the gaming machine 10 houses a bank of buttons 22 for enabling a player to interact with the gaming machine, in particular during game play and providing a player instruction input mechanism. The mid-trim 20 also houses a credit input mechanism for example a coin input chute and/or a bill collector 24B. Other credit input mechanisms may also be employed, for example, a card reader for reading a smart card, debit card or credit card.

Artwork and/or information, for example pay tables and details of bonus awards and other information or images relating to the game may be provided on a front panel 29 of the console 12. A coin tray 30 is mounted beneath the front panel 29 for dispensing cash payouts from the gaming machine 10.

The display 14 shown in FIG. 1 is in the form of a video display unit, particularly a cathode ray tube screen device. Alternatively, the display 14 may be a liquid crystal display, plasma screen, any other suitable video display unit, or the visible portion of an electromechanical device. The top box 26 also includes a display which may be of the same type as the display 14, or of a different type. The display(s) 14, 26 and the buttons 22 collectively provide a player interface.

A player marketing module (PMM) 50 having a display 52 is mounted to the cabinet 12 and connected to the gaming machine 10 via a serial port of the main board of the gaming machine. The main purpose of the PMM 50 is to allow the player to interact with a player loyalty system. The PMM has a magnetic card reader for the purpose of reading a player tracking device in the form of a magnetic swipe card, for example as part of a loyalty program. However other reading devices may be employed and the player tracking device may be in the form of a card, flash drive or any other portable storage medium capable of being read by a reading device. PMMs are also sometimes known as player tracking modules (PTMs).

Figure 2:
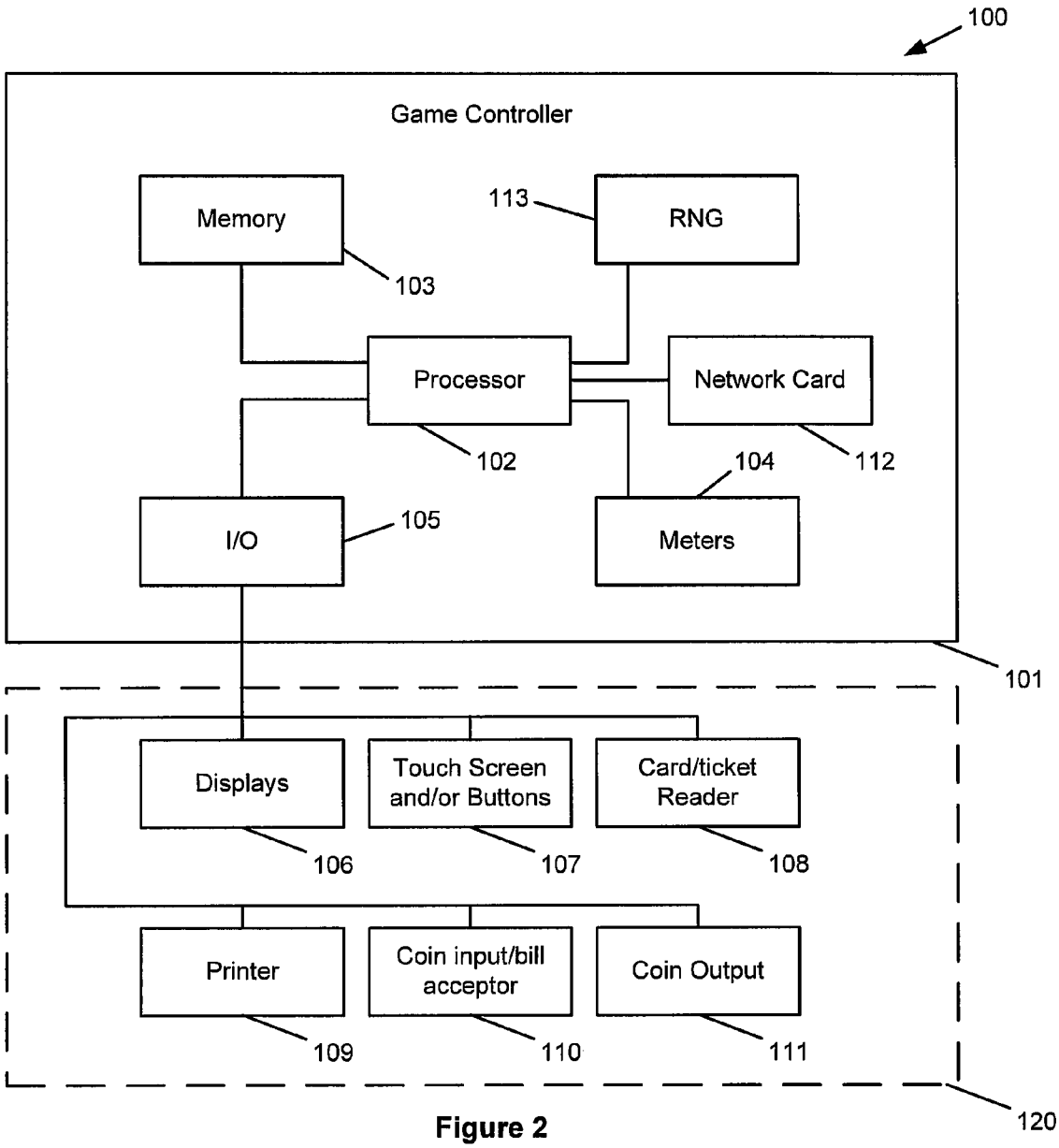
FIG. 2 is a block diagram of the operative components of an exemplary gaming machine.

FIG. 2 shows a block diagram of operative components of the gaming machine 10 which includes a game controller 101 having a processor 102. Instructions and data to control operation of the processor 102 are stored in a memory 103, which is in data communication with the processor 102. Herein the term "processor" is used to refer generically to any device that can process game play instructions in accordance with game play rules and may include: a microprocessor, microcontroller, programmable logic device or other computational device, a general purpose computer (e.g. a PC) or a server.

Typically, the gaming machine 10 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 10. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 2, a player interface 120 includes peripheral devices that communicate with the game controller 101 including one or more displays 106, buttons and/or a touch screen 107, a card and/or ticket reader 108, a printer 109, a bill acceptor and/or coin input mechanism 110 and a coin output mechanism 111. Additional hardware may be included as part of the gaming machine 10, or hardware may be omitted as required for the specific implementation.

In addition, the gaming machine 10 may include a communications interface 112, which may include a number of components, for example a network card and a serial port. The communication interface may, for example, send status information, accounting information or other information to a central controller, server or database and receive data or commands from the central controller, server or database. However, in the specific embodiment, all communications with any central devices are via the PMM and more specifically via the serial port of the main board of the gaming machine.

Figure 3:
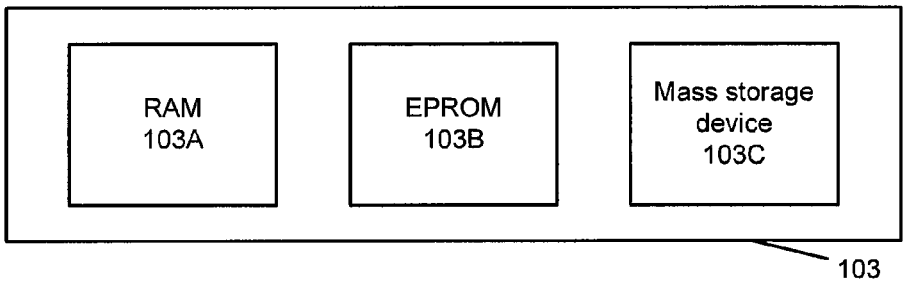
FIG. 3 is a block diagram of an exemplary memory of a gaming machine.

FIG. 3 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

Figure 4:
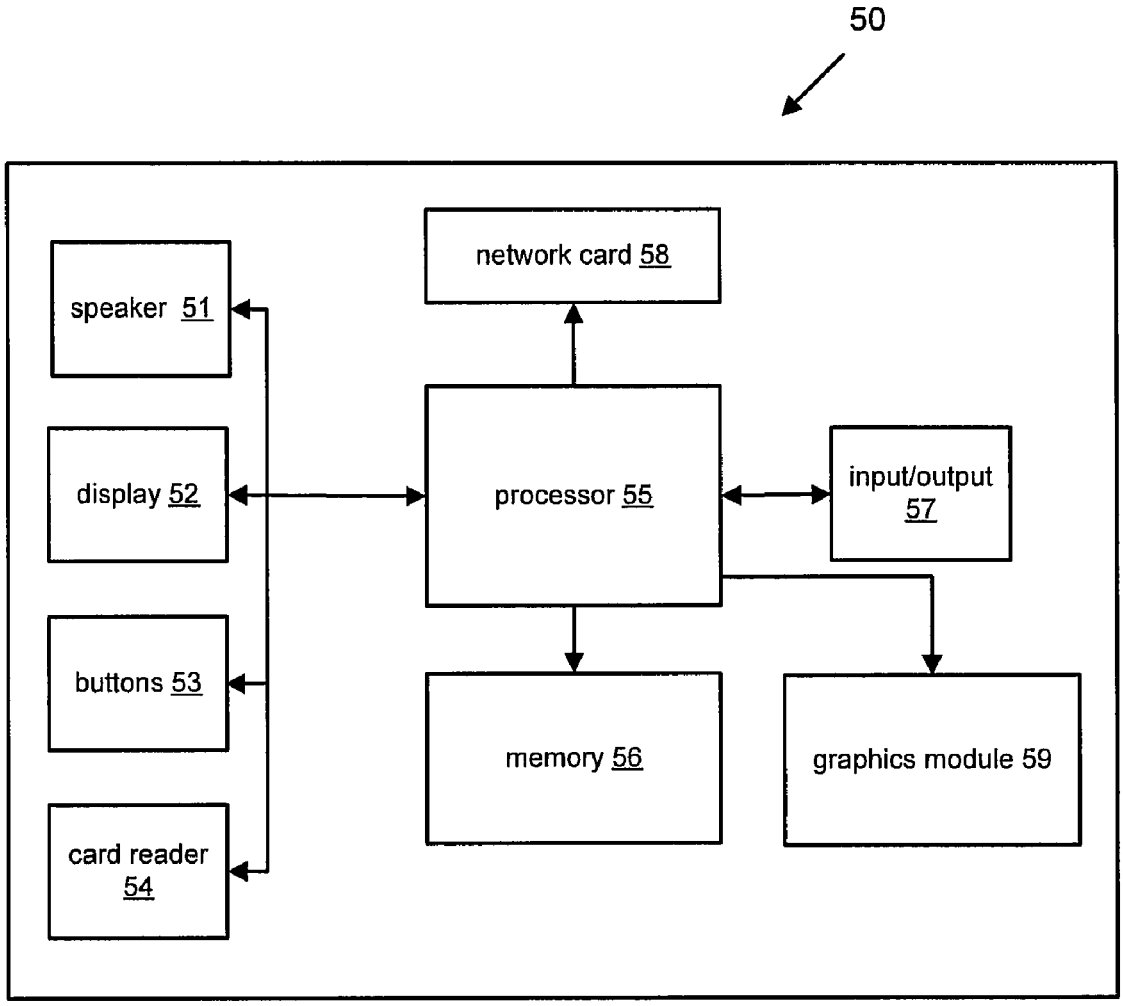
FIG. 4 is a block diagram of an exemplary player marketing module.

FIG. 4 is a block diagram of a player marketing module 50. The player marketing module 50 is connected via input/output port 57 to a serial input output port of the input/output section 105 of the electronic gaming machine. The player marketing module has a card reader 54 and a display 52 which may be a touch screen display. The PMM 50 may also have buttons 53 for receiving a player input (at least in embodiments where there is no touch screen display) and a speaker 51. Input received from the card reader 54 is processed by processor 55 based on the data stored in memory 56. The PMM 50 is connected to the loyalty system by a network card 58. Thus, in the embodiment, the gaming machine 10 communicates with the feature game controller and the loyalty system via the PMM as described in further detail below.

Processor 55 is also arranged to communicate with a gaming machine 10 via input/output port 54 to cause locking of the gaming machine. The PMM 50 is typically linked to the EGM via the serial port of the EGM and the EGM is arranged to require a response to a polling signal from the PMM 50 on the serial port before it can carry out a further base game or accept further playing instructions. The PMM 50 can exploit this requirement to lock the EGM by failing to respond to the polling signal. Thus, the PMM 50 can lock the EGM while playing the feature game if this is desired in the implementation. When the feature game has been played, the PMM 50 responds to the polling signal and the EGM 10 is unlocked. Persons skilled in the art will appreciate that other locking mechanism can be employed, and indeed, in some embodiments, it may be advantageous to allow concurrent play of the feature and base games. For example, some players do not like lengthy feature games as they interrupt play of the base game. This can be avoided by carrying out the feature game contemporaneously with a base game.

Figure 5:
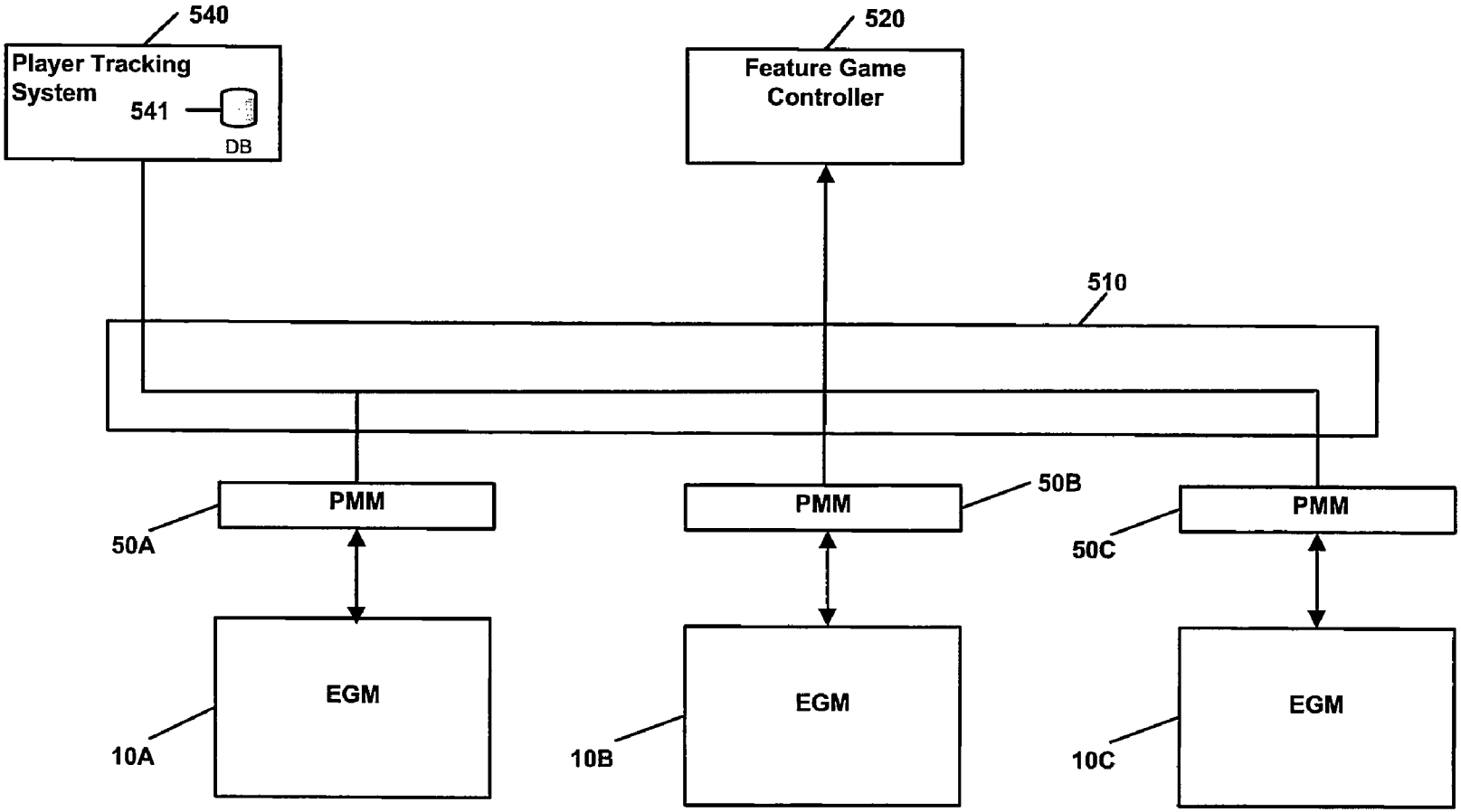
FIG. 5 shows a plurality of gaming machines connected to a feature game controller via respective player marketing modules.

FIG. 5 shows a series of electronic gaming machines 10 connected via respective player marketing modules 50 over a communications network 510 to a feature game controller 520 and a player tracking system 540. The communications network 510 may be any suitable communications network for example an Ethernet.

Figure 6:
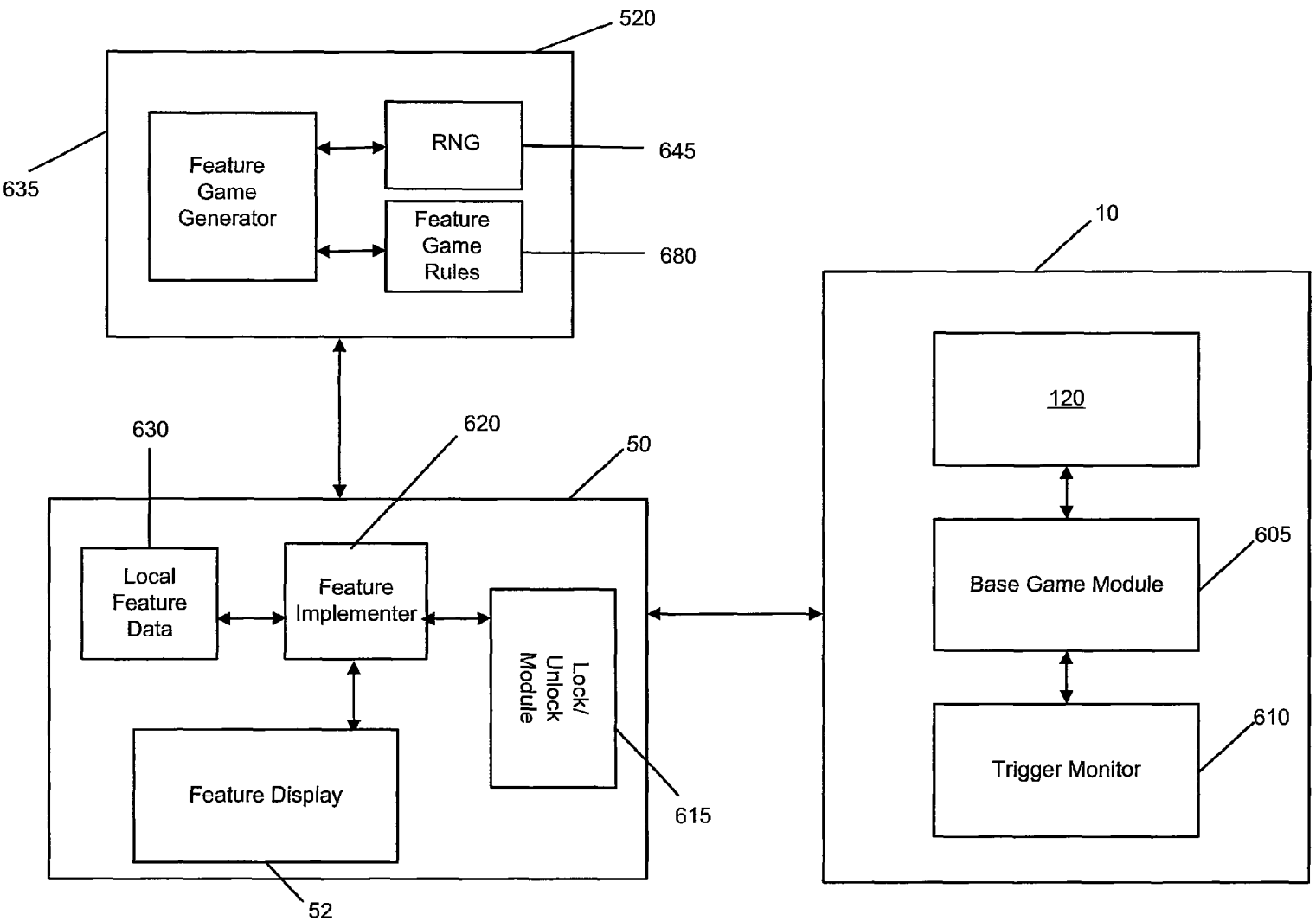
FIG. 6 is a functional block diagram of an embodiment of a gaming system.

As indicated above, the present invention is arranged such that the base game is conducted on the gaming machine 10 while the feature game is presented on a separate display provided by the player marketing module 50. FIG. 6 is a functional block diagram which illustrates how this is implemented. As shown in FIG. 6, the electronic gaming machine 10 implements a base game module 605, typically as software executed by the processor of the gaming machine 10. However, a person skilled in the art will appreciate that modules like the base game module 605 can also be implemented as dedicated hardware.

The base game module 605 is in data communication with a player interface 120 as described in relation to FIG. 2 which thus provides a base game player interface having a display and an instruction input mechanism which allows the player to play the base game and view the playing of the base game including game outcomes.

In the embodiment, the trigger monitor 610 is a separate software routine implemented to monitor when a trigger condition occurs in the base game. The trigger condition can be any of the trigger conditions know in the art including the occurrence of a particular symbol combination in the base game, turnover in the base game etc.

When a trigger condition occurs, the trigger monitor 610 outputs trigger data to the PMM 50. The trigger data causes the lock/unlock module 615 to lock the EGM 10 and advise the feature implementer 620 that a feature game is to begin 620. The feature implementer requests a feature game from the feature game generator 635 of feature game controller. The feature game generator randomly generates a feature game based on feature game rules 640 and a number from random number generator 645. Persons skilled in the art will appreciate that the random number may be truly random or pseudo random.

The feature game generator 635 generates feature game data which specifies the feature game and sends the feature data to the PMM 50. The feature implementer 620 of the PMM 50 combines this data with local feature data 630 which may be, for example, graphics data to render the feature game on the feature display 52—i.e. in this embodiment the display of the PMM 50.

Thus, in the embodiment, some of the functions for carrying out the feature game including generating the feature games are implemented as feature game controller 520 whereas others more minor functions are implemented on the PMM 50. Hence, the PMM 50 acts as a thin client and the feature game controller as a server.

Accordingly, this embodiment, takes advantage of the PMM's ability to render graphic data with an inbuilt graphics module 59 which can be accessed by the feature implementer 620 while the feature game is generated remotely by the feature game controller 520.

This allows, for example, feature games to be updated in respect of base games without requiring the EGM 10 to be updated and for more computationally intensive activities to be carried out on the feature game controller 520. Further, it draws the attention of the player to the PMM.

Persons skilled in the art will appreciate that the feature game can be in accordance with known feature games in the art including a series of free games, a series of free spins, or the player may be required to pay for the games.

While not illustrated specifically in FIG. 6, it will be appreciated that the player may press buttons 53 or where a touch screen display is provided, the touch screen display 52 of the PMM 50 in order to input game instructions which are required as part of a particular feature game.

Figure 7:
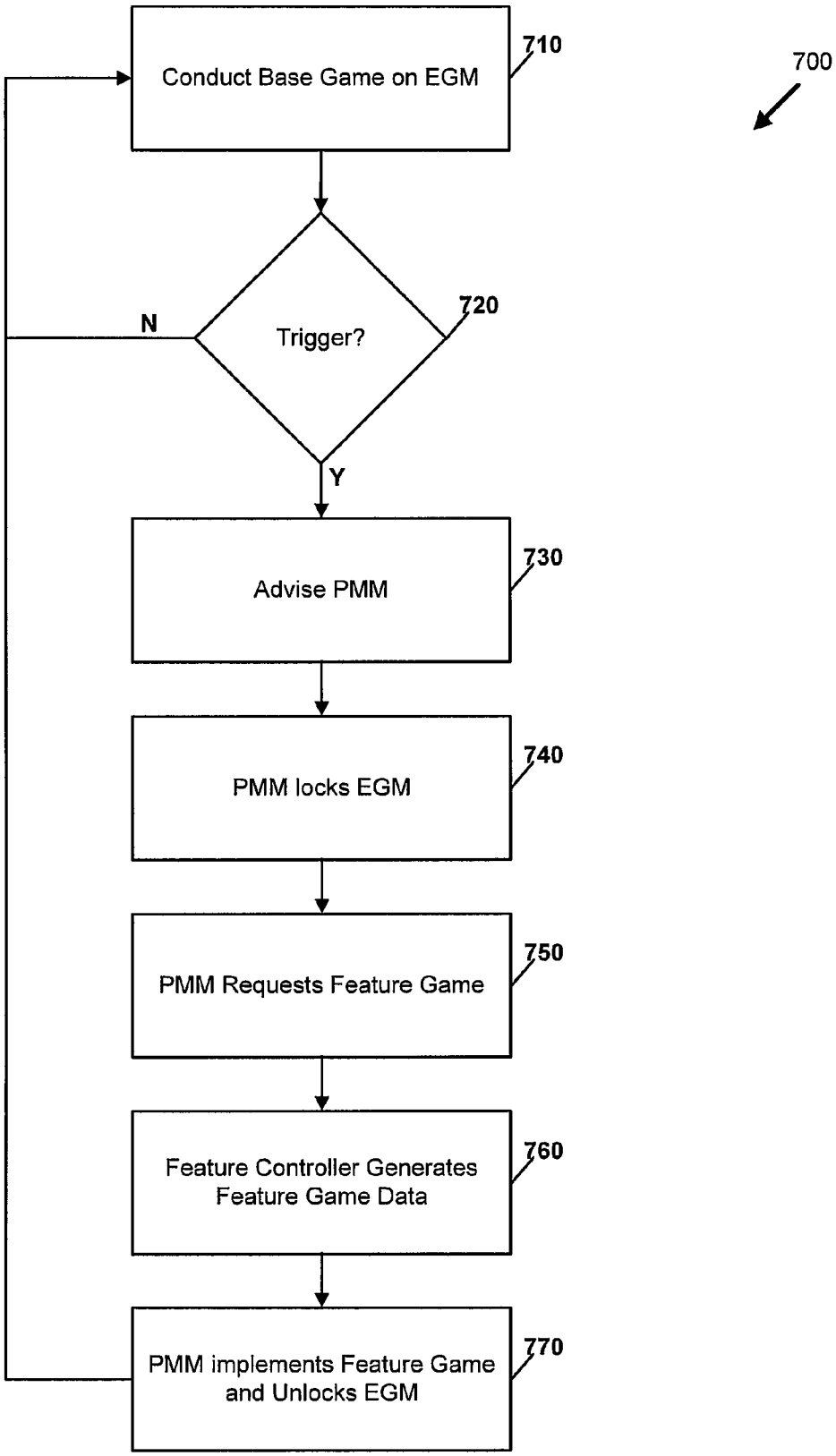
FIG. 7 is a flow chart of an embodiment.

The method 700 of the embodiment is summarised in FIG. 7 which indicates that a base game was conducted on the EGM 710, a trigger monitor monitors for whether a trigger condition occurs and if not, continues to conduct the base game 710.

When it is determined 720 that a trigger condition has occurred, the PMM is advised 730 and the PMM causes the EGM to lock 740. The PMM requests the feature game from the feature game controller 750 and the feature game controller generates feature game data which it sends to the PMM 760. The PMM implements the feature games 770 and subsequent to its completion, unlocks the EGM 770.

It will be understood to persons skilled in the art of the invention that many modifications may be made without departing from the spirit and scope of the invention.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention. It is to be understood that, if any prior art publication is referred to herein, such reference does not constitute an admission that the publication forms a part of the common general knowledge in the art, in Australia or any other country.

The invention claimed is:

1. A hybrid gaming system comprising:

a cabinet;

an electronic gaming machine (EGM) mounted to the cabinet, the EGM comprising:

a base game interface disposed within the cabinet and comprising a display and a base game player instruction input mechanism, a processor disposed within the cabinet and arranged to conduct a base game based on at least one player instruction received from the base game player instruction input mechanism;

a feature game device mounted to the cabinet, the feature game device comprising:

a feature game display mounted to the cabinet and a feature game instruction mechanism operable by the player to input at least one instruction;

a trigger monitor arranged to determine that a trigger event has occurred such that a feature game is to be conducted; and a feature game controller located remotely from the EGM and the feature game device;

wherein the feature game device is in communication with the feature game controller and is responsive to the trigger monitor to generate feature data for at least one feature game to be displayed on the feature game display and to process the at least one instruction, and wherein the feature game controller is arranged to select one of a number of predefined feature games for combining with the feature data and for implementing on the feature game display; and wherein the EGM is in communication with the feature game device and is responsive to a lock command from the feature game device to lock play of the EGM while the selected feature game is being implemented, the EGM further is responsive to an unlock command from the feature game device once the feature game is complete.

2. A hybrid gaming system as claimed in claim 1, wherein the feature game device comprises a feature game processor arranged to process feature data received from the feature game controller and to cause the feature game display to display the game.

3. A hybrid gaming system as claimed in claim 2, wherein the feature game device comprises a memory storing local data and the feature game processor processes the local data in conjunction with the feature data to cause the display to display the feature game.

4. A hybrid gaming system as claimed in claim 3, wherein the local data comprises at least graphics data.

5. A hybrid gaming system as claimed in claim 1, wherein the feature game device is in data communication with the processor of the EGM.

6. A hybrid gaming system as claimed in claim 5, wherein the feature game device locks play of the EGM comprises preventing the processor of the EGM from conducting the base game during the feature game.

7. A hybrid gaming system as claimed in claim 5, wherein the feature game device is in data communication with the processor of the EGM via a serial port of the EGM.

8. A hybrid gaming system as claimed in claim 1, wherein the feature game device provides at least one additional function independent of the feature game.

9. A hybrid gaming system as claimed in claim 8, wherein the feature game device is a player marketing module in data communication with a player tracking system.

10. A hybrid gaming system as claimed in claim 1, wherein the feature game device implements the trigger monitor.

11. A hybrid gaming system as claimed in claim 1, wherein the processor of the EGM implements the trigger monitor.

12. A hybrid gaming system as claimed in claim 1, and further comprising a plurality of EGMs in data communication with the feature game controller, the feature game controller arranged to generate feature data for a feature device of each EGM on demand.

13. A hybrid gaming method for use with an electronic gaming machine (EGM) having a base game with a trigger event, and a feature game device having a feature game display and a feature game instruction mechanism, and a remotely-located feature game controller, the method comprising:

conducting the base game on the electronic gaming machine (EGM);

monitoring for the trigger event to occur in the base game;

conducting a feature game; comprising:

receiving at least one instruction from the feature game instruction mechanism;

generating feature data via the feature game device specifying at least one feature game;

selecting via the feature game controller one of a number of predefined feature games for combining with the feature data;

generating a lock command from the feature game device to lock play of the EGM while the selected feature game is being implemented;

generating an unlock command from the feature game device once the feature game is complete; and displaying a feature game specified by the feature data on the feature game display.

14. A method as claimed in claim 13, further comprising storing local data at the EGM and processing the local data in conjunction with the feature data to cause the display to display the feature game.

15. A method as claimed in claim 14, and wherein generating a lock command comprises preventing the EGM from conducting the base game during the feature game.

16. A hybrid gaming apparatus for use with a remotely-located feature game controller, the apparatus comprising:

an electronic gaming machine (EGM) comprising:

a cabinet;

an electronic gaming machine (EGM) mounted to the cabinet, the EGM comprising:

a base game interface disposed within the cabinet and comprising a display and a base game player instruction input mechanism, a processor disposed within the cabinet and arranged to conduct a base game based on at least one player instruction received from the base game player instruction input mechanism;

a feature game device mounted to the cabinet, the feature game device comprising:

a feature game display mounted to the cabinet and a feature game instruction mechanism operable by the player to input at least one instruction, the feature game display operable to display at least one feature game based on a combination of feature game data generated locally and a selected one of a number of predefined feature games received from the feature game controller, and wherein the EGM is in communication with the feature game device and is responsive to a lock command from the feature game device to lock play of the EGM while the selected feature game is being implemented, the EGM further is responsive to an unlock command from the feature game device once the feature game is complete.

17. A hybrid gaming apparatus as claimed in claim 16, wherein the feature game device comprises a feature game processor arranged to process feature data received from the feature game controller and to cause the feature game display to display the game.

18. A hybrid gaming apparatus as claimed in claim 17, wherein the feature game device comprises a memory storing local data and the feature game processor processes the local data in conjunction with the feature data to cause the display to display the feature game.

19. A hybrid gaming apparatus as claimed in claim 18, wherein the local data comprises at least graphics data.

20. A hybrid gaming apparatus as claimed in claim 16, wherein the feature game device is in data communication with the processor of the EGM.

21. A hybrid gaming apparatus as claimed in claim 20, wherein the feature game device locks play of the EGM comprises preventing the processor of the EGM from conducting the base game during the feature game.

22. A hybrid gaming apparatus as claimed in claim 20, wherein the feature game device is in data communication with the processor of the EGM via a serial port of the EGM.

23. A hybrid gaming apparatus as claimed in claim 16, wherein the feature game device provides at least one additional function independent of the feature game.

24. A hybrid gaming apparatus as claimed in claim 23, wherein the feature game device is a player marketing module in data communication with a player tracking system.

25. A hybrid gaming apparatus as claimed in claim 16, wherein the feature game device implements the trigger monitor.

26. A hybrid gaming apparatus as claimed in claim 16, wherein the processor of the EGM implements the trigger monitor.

* * * * *